United States Patent [19]

Pistone

[11] 4,253,897

[45] Mar. 3, 1981

[54] PROCESS FOR CREATING PLAYTHINGS, PARTICULARLY THOSE THAT FLY, AND A TOY MADE WITH THE SAID PROCESS

[75] Inventor: Marco M. Pistone, Solarolo, Italy

[73] Assignee: Cartografica Santerno S.p.A., Bologna, Italy

[21] Appl. No.: 37,271

[22] Filed: May 9, 1979

[30] Foreign Application Priority Data

May 31, 1978 [IT] Italy ..... 3456 A/78

[51] Int. Cl.[3] ..... B32B 31/00; A63H 27/00; A63H 13/20; A63F 9/02

[52] U.S. Cl. ..... 156/256; 46/76 R; 46/79; 46/76 A; 272/31 A; 273/428; 156/60; 156/293; 156/294

[58] Field of Search ..... 156/78, 256, 60; 46/76 R, 79, 76 A, 80, 293; 273/95 B, DIG. 2; 272/1 C, 31 A; 428/71

[56] References Cited

U.S. PATENT DOCUMENTS 2,767,436 10/1956 Noland et al. ..... 46/76 R

FOREIGN PATENT DOCUMENTS 2725870 12/1978 Fed. Rep. of Germany ..... 46/76 R
774247 5/1957 United Kingdom .
814739 6/1959 United Kingdom .
934039 8/1963 United Kingdom .
1426077 2/1976 United Kingdom .
1484451 9/1977 United Kingdom .

OTHER PUBLICATIONS

American Modeler, How to Make Plane Parts from Expanded Polystyrene, Jun. 1967.

*Primary Examiner*—John T. Goolkasian
*Assistant Examiner*—L. Falasco

[57] ABSTRACT

A process for creating playthings that fly, and airplanes in particular, that unites extreme lightness with considerable tensile strength, both for the individual component parts and for the assembled model.

The said process is constituted by a number of stages that comprise: the production, through the punching of extruded polystyrene, of one or more members of limited thickness and of suitable shape that constitute the fundamental parts of the toy; the production of a pair of facing members, of a shape and an outline corresponding to that of each limited thickness member; and finally, the fixing of the said pair on both sides of the said members of limited thickness, so that the outline thereof is fully covered.

3 Claims, 2 Drawing Figures

PROCESS FOR CREATING PLAYTHINGS, PARTICULARLY THOSE THAT FLY, AND A TOY MADE WITH THE SAID PROCESS

The subject of the present invention is a process for creating playthings, particularly those that fly, and a toy made with the said process.

Various types of playthings are known and amongst those that fly, the one that is most common is certainly represented by the aeroplane, and although this is used as an example in the description given herein, the scope of the invention is not limited thereto. The said aircraft, made in the most varied forms, utilizing different types of materials, such as balsa, cardboard, plastic and similar, are able to cover a certain span unpowered when launched in the air by hand or through the thrust of elastic accessory means.

Only lately has use been made of an extremely light and, above all, cheap material highly suited to the purpose, that is to say, polystyrene, which is punched into the parts that reproduce the fundamentals of the aeroplane, the symbols and the emblems typical of the particular aircraft it is wished to reproduce being printed directly on to the said material. The said parts are then subsequently assembled and slotted together by the purchaser, thus giving rise to the finished toy.

One problem with the said method consists in the fact that since the particular material used, that is to say, polystyrene, is, as stated above, light, it is somewhat fragile and is devoid of high tensile strength characteristics; this consequently limits the life span of the toy when it is subjected, as is to be expected, to intensive use.

Furthermore, since the said playthings are intended to reproduce the shape of the original model, the need exists to resort to suitable counterweights so as to balance the aircraft and allow them to fly in a way that is reasonably realistic. With the method used up until now, the said counterweights are placed at the tip of the cockpit in the form of a support for the propeller, obviously in the case of reproductions of aeroplanes that utilize such engines, with the problem that at times it is not possible to establish the desired equilibrium; then again there is the fact that in the case of reproductions of aircraft of the latest generation, that are jet powered, there are no engines at the tip and thus it is difficult, if not impossible, to balance them.

The essential object of the present invention is, therefore, to overcome the aforementioned problems through a process for creating playthings, and particularly those that fly, with which it is possible to unite extreme lightness with tensile strength that is considerable, both for the individual components parts and for the assembled model, in addition to the possibility of being able, because of the process used, to insert in the component parts, at the necessary points, one or more non-visible counterweights independently of the type of model reproduced, this all being done through a method that is extremely simple and economical in comparison with the results that can be achieved.

This and other objects too are all attained with the process forming the subject of the present invention, essential features of which are that it comprises the following stages:

(a) the production, through the punching of extruded polystyrene, of one or more members of limited thickness and of suitable shape that constitute the fundamental parts of the toy to be created;

(b) the production of a pair of facing members, of a shape and an outline corresponding to that of each individual limited thickness member;

(c) the fixing of the said pair on both sides of the said members of limited thickness, so that the outline thereof is fully covered.

Further characteristics and advantages of the process in question will now be described more fully with the aid of the figures illustrated purely as an example on the accompanying drawing, in which.

Figure 1:
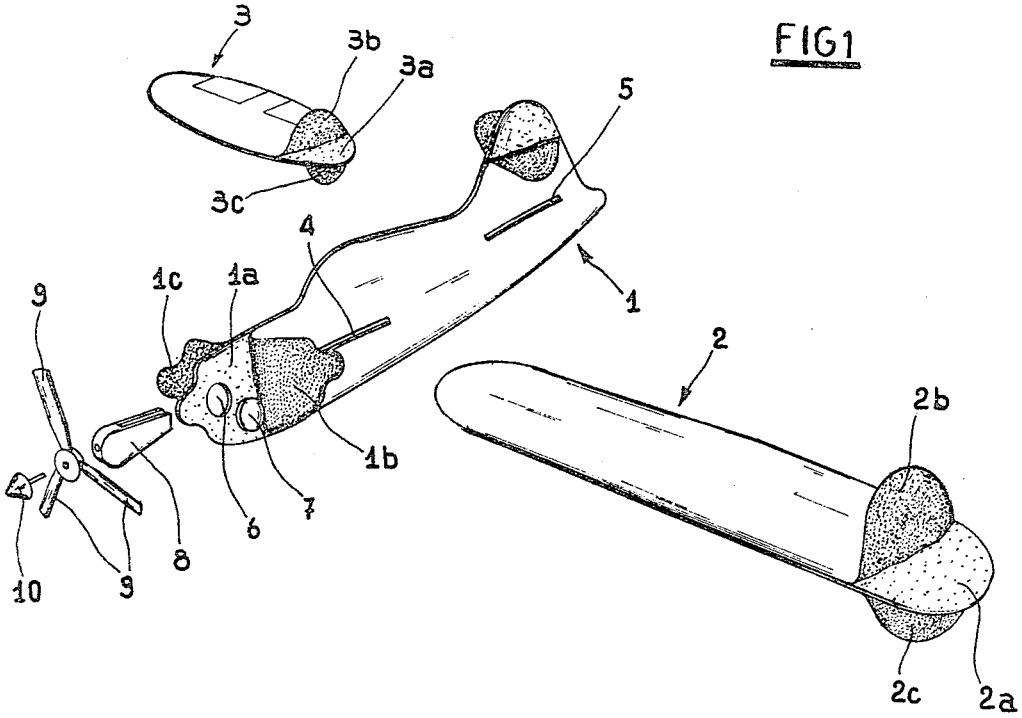
FIG. 1 shows, in exploded form, an example of one form of embodiment for a plaything produced in accordance with the process forming the subject of the present invention which, in the case in question, is an aeroplane.
Figure 2:
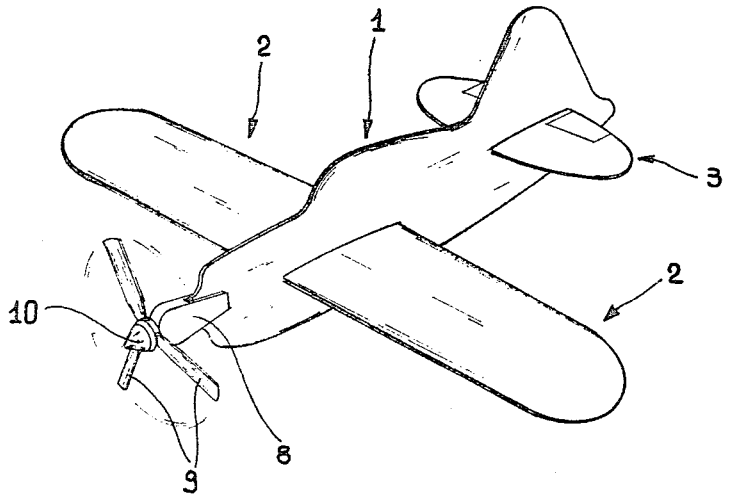
FIG. 2 shows, in a complete perspective view, the aircraft depicted in FIG. 1 fully assembled.

With reference to the accompanying figures, at (1), (2) and (3) the cockpit, the wings and the empennage or tail unit are shown in that order for an aeroplane taken as an example of a flying toy that can be made with the process in question.

Each one of the said parts is constituted by a flat member **(1*a*), (2*a*), and (3*a*)**, respectively, made by punching extruded polystyrene into one piece laminations of limited thickness that constitute the light weight core of the said toy.

In order to strengthen the said polystyrene members mechanically, two pieces of paper **(1*b*–1*c*), (2*b*–2*c*) and (3*b*–3*c*)**, respectively, one side of which is self-adhesive, are stuck externally, one on each side of the said polystyrene members, the outer non-adhesive side having printed thereon one or more graphic indications that characterize the particular aeroplane being reproduced. The said pieces of paper which are also punchings, are of a shape and outline corresponding to that of the polystyrene member to be matched over the full area thereof, and their task is to reinforce the polystyrene member underneath just enough to ensure that it has sufficient tensile strength.

The polystyrene member **(1*a*) and the pieces of self-adhesive paper (1*b*–1*c*) are provided, in corresponding positions, with two slots (4) and (5) for the insertion and subsequent fixing of the wings (2) and the tail unit (3) which are slotted therein. At the front of the said member (1*a*) a through hole (6) is also provided and, at the time of the fixing of the two self-adhesive pieces of paper (1*b*–1*c*), a counterweight (7) of a size and gauge corresponding to that of the hole (6)** is inserted therein to contribute towards the dynamic balance of the aeroplane.

In the case of aeroplanes with a propeller, use can be made of a support (8) depicting the engine which is fixed by slotting it into the tip of the cockpit (1) and through a pin (10) this carries a propeller (9). It is obvious that in this particular case the counterweight (7) will be calculated to suit the weight of the group made up of (8), (9) and (10).

Vice versa, in the case of reproductions of jet aircraft, use is made of one or more counterweights similar to (7), at the necessary points, without these being visible from outside since they are covered with the self-adhesive paper.

It has been possible in this way to create an extremely light, simple and functional aeroplane that does fly and is of adequate tensile strength also when assembled, with the possibility of a dynamic balance.

The above affirmation can obviously be extended to any type of plaything that flies, made out of one or more parts, and even to any toy in general that uses as a core, the aforementioned polystyrene member.

I claim:

1. Method for constructing a flying toy comprising the steps of:

(a) punching from extruded polystyrene at least one member of limited thickness and of a suitable shape for said toy having a central body portion;

(b) forming a hole in said central body portion member and inserting a weight therein, the location, size and gauge of said weight being calculated to contribute towards the dynamic balance of said toy; and (c) fixing a pair of facing members to both sides of said one member having a shape and outline corresponding to that of said one member, whereby the latter is fully covered including said weight.

2. Method according to claim 1, wherein said toy is constructed from a plurality of members of limited thickness, said method further comprising providing at least one slot in one of said members, and inserting another of said members into said slot.

3. Method according to claim 1, wherein said facing members comprise self-adhesive paper having decoration on the outside thereof.

* * * * *